US008525631B2

(12) United States Patent
Balog

(10) Patent No.: US 8,525,631 B2
(45) Date of Patent: Sep. 3, 2013

(54) UNDERWATER POWER CONNECTOR SYSTEM AND USE THEREOF

(75) Inventor: Georg Balog, Tranby (NO)

(73) Assignee: Nexans, Paris (FR)

( * ) Notice: Subject to any disclaimer, the term of this patent is extended or adjusted under 35 U.S.C. 154(b) by 0 days.

(21) Appl. No.: 13/272,460

(22) Filed: Oct. 13, 2011

(65) Prior Publication Data

US 2012/0126924 A1 May 24, 2012

(30) Foreign Application Priority Data

Nov. 1, 2010 (NO) ..... 20101526

(51) Int. Cl.
*H01F 27/24* (2006.01)
*H01F 17/04* (2006.01)

(52) U.S. Cl.
USPC ..... 336/212; 336/221; 336/216; 439/950

(58) Field of Classification Search
USPC ..... 336/212, 216, 217, 221, 234; 439/950
See application file for complete search history.

(56) References Cited

U.S. PATENT DOCUMENTS 3,549,990 A * 12/1970 Hochheiser ..... 323/345
3,550,682 A * 12/1970 Fowler ..... 166/338
4,303,902 A * 12/1981 Lesster et al. ..... 336/83
4,612,527 A * 9/1986 Third et al. ..... 336/5
4,669,792 A 6/1987 Kjedstad
5,506,560 A * 4/1996 Takeuchi et al. ..... 336/83
5,719,546 A * 2/1998 Ito et al. ..... 336/180
6,042,385 A * 3/2000 Watanabe et al. ..... 439/38
6,057,668 A * 5/2000 Chao ..... 320/108
7,557,687 B2 * 7/2009 Watanabe ..... 336/234
8,102,230 B2 * 1/2012 Eriksen ..... 336/178

FOREIGN PATENT DOCUMENTS

GB 2312910 11/1997
GB 2318397 4/1998
WO 2009048339 4/2009

OTHER PUBLICATIONS

Norwegian Search Report dated May 27, 2011.

* cited by examiner

*Primary Examiner* — Mohamad A Musleh
*Assistant Examiner* — Joselito Baisa
(74) *Attorney, Agent, or Firm* — Sofer & Haroun, LLP

(57) ABSTRACT

An underwater power connection system (10) has at least two separable magnetic cores (40, 50) which are operable when coupled together to form a magnetic circuit, where the at least two cores (40, 50) are provided with respective one or more windings, and said cores (40, 50) include a transverse magnetic member arrangement (60, 80) supporting magnetic limbs (70, 90), where the limbs (70, 90) are elongate and are adapted to intermesh with their lateral sides mutually abutting for providing the magnetic circuit when the system (10) is in its assembled state (210), and where the limbs (70,90) are of tapered form towards their distal ends.

9 Claims, 3 Drawing Sheets

UNDERWATER POWER CONNECTOR SYSTEM AND USE THEREOF

RELATED APPLICATION

Figure 1:
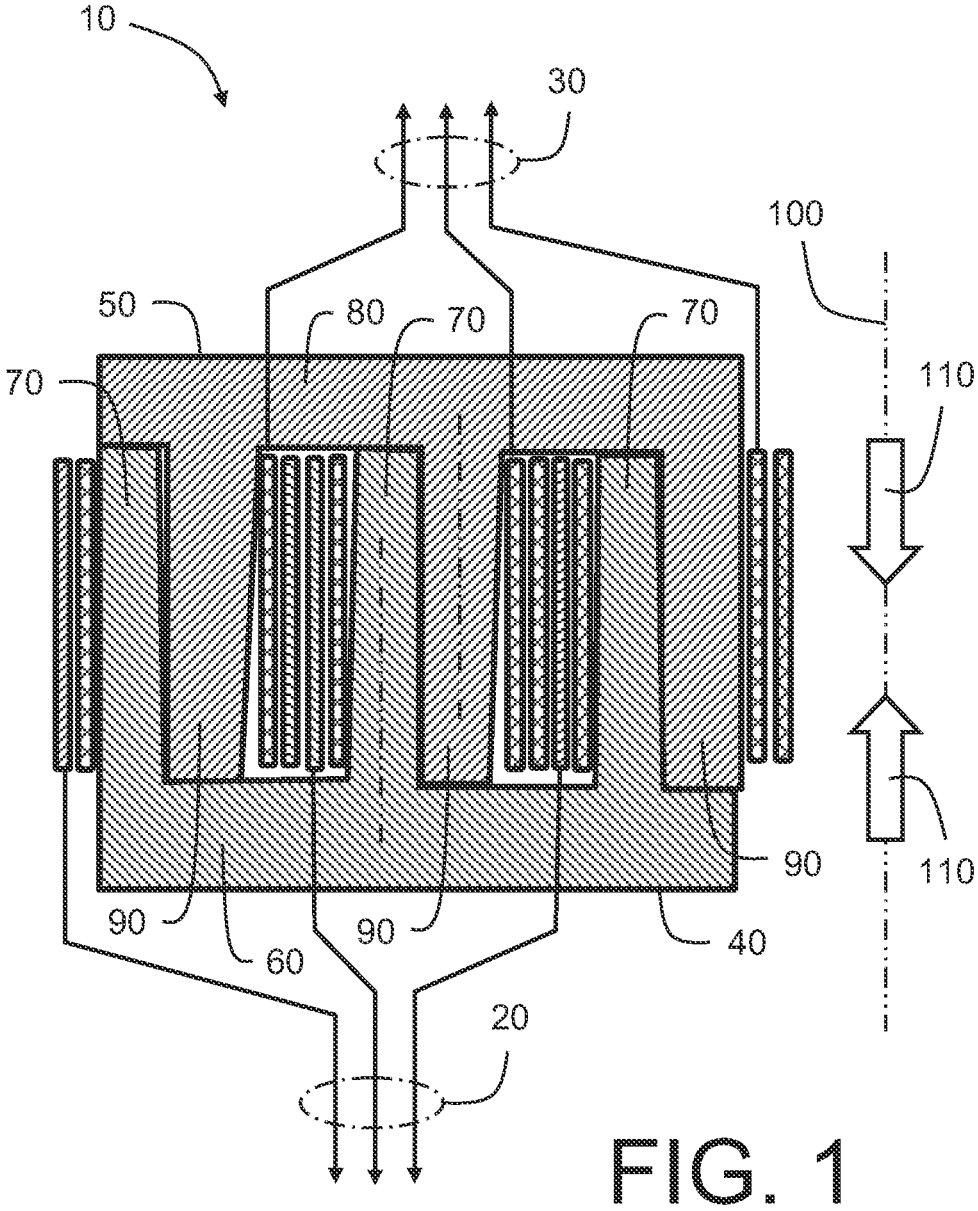

This application claims the benefit of priority from Norwegian Patent Application No. 2010 1526, filed on Nov. 1, 2010, the entirety of which is incorporated herein by reference.

FIELD OF THE INVENTION

The present invention relates to an underwater power connection system, for example for transferring electrical power in underwater environments via connector elements which can be coupled together and mutually decoupled. Moreover, the present invention also concerns methods of coupling and uncoupling connector elements of underwater power connection systems.

BACKGROUND OF THE INVENTION

In contemporary off shore installations, for example oil and gas production platforms, drilling rigs, offshore wind energy facilities, ocean wave energy facilities and mining activities, there often arises a need to transfer considerable electrical power, for example for providing electrical power to electric motors and for coupling outputs from electrical generators. Such transfer of considerable power is beneficially achieved at elevated potentials in an order of kilovolts (kV) for reducing an amount of associated electrical current flowing in electrical wires and cables. It is contemporarily found in practice difficult to provide high-reliability electrical connections in underwater environments, especially when elevated operating potentials are required. Saline seawater leaks, or even elevated humidity resulting from ingress of seawater at elevated operating pressures, are susceptible to cause flashovers and associated short circuits in electrical apparatus. Electrical flashover damage is often permanent when polymer insulators become thereby charred and/or ablated.

Power transfer via magnetic coupling through connector elements which are susceptible to being coupled together and mutually uncoupled is known from a published United Kingdom patent no. GB 2 318 397A (Wilson, GEC). There is described a connector comprising a pair of pistons defining respective mating surfaces. One of the pistons is mounted within a bore in a first support member for movement along a first axis and arranged to engage a resilient seal mounted within the bore. Another of the pistons is mounted within a bore in a second support member for movement along a second axis that is parallel to the fist axis and arranged to engage a resilient seal mounted within the bore. The first and second support members are arranged for relative movement only in a direction at right angles to first and second axes for enabling the two axes to be mutually aligned. Springs are included for biasing the pistons towards each other such that their mating surfaces operably wipe each other during alignment of the two axes. The magnetic coupling also includes a fluid connector for admitting pressurized fluid between each piston and its associated support member whereby, in operation, the aligned pistons are operable to press the mating surfaces together.

Such a known magnetic coupling has several potential operating problems associated therewith. For example, fluid connection to the pistons creates for complication with yet more fluid-bearing tubes that are susceptible to rupture under high operating pressures. Moreover, the wiping action of the abutting surfaces is potentially inadequate for avoiding significant build up of non-magnetic growth onto the abutting mating surfaces. Furthermore, known magnetic couplings are also potentially difficult to manoeuvre and align during attachment in underwater environments where optical viewing is impaired, for example as a consequence of silt or marine microbes.

These contemporary known systems suffer many problems which render them unsuitable for coupling significant power in an order to tens, or even hundreds, of kilowatts (kW) magnitude.

SUMMARY OF THE INVENTION

The present invention seeks to provide an improved underwater power connection system which is capable of operating more reliably and/or transferring greater magnitudes of electrical power therethrough.

According to a first aspect of the present invention, there is provided an underwater power connection system comprising at least two separable magnetic cores which are operable when coupled together to form a magnetic circuit, wherein the at least two cores are provided with respective one or more windings and said cores include a transverse magnetic member arrangement supporting magnetic limbs, wherein the limbs are elongate and are adapted to intermesh with their lateral sides mutually abutting for providing the magnetic circuit when the system is in its assembled state, characterized in that the limbs are of tapered form towards their distal ends.

The invention is of advantage in that the underwater power connection system, by way of its intermeshing elongate magnetic limbs is capable of at least one of: performing more reliably in operation, coupling greater quantities of power therethrough.

Optionally, the underwater power connection system is implemented so that the limbs are elongate in a direction corresponding to a direction in which the cores are mutually coupled together and/or decoupled from one another.

Optionally, the underwater power connection system is implemented so that the cores are fabricated from at least one of: laminate magnetically permeable sheet, magnetically permeable wire, ferrite materials.

Optionally, the underwater power connection system is implemented so that the cores have associated therewith multiple windings for enabling the system to couple multi-phase alternating electrical power therethrough.

Optionally, the underwater power connection system is implemented so that the windings are included within hollow non-magnetic metal enclosures including insulating fluid which is arranged to be maintained at a substantially similar pressure to an underwater operating environment of the system.

Optionally, the underwater power connection system is implemented to include frequency conversion units coupled to the windings for enabling power to be transferred via the cores at an increased alternating frequency.

Optionally, the underwater power connection system is implemented to include a latching mechanism for maintaining the at least two cores coupled together when in a mutually coupled state.

According to a second aspect of the invention, there is provided a method of coupling an underwater power connection system comprising at least two separable magnetic cores which are operable when coupled together to form a magnetic circuit, wherein the at least two cores are provided with respective one or more windings, characterized in that said method includes:

(a) arranging for the at least two separable magnetic cores to include a transverse magnetic member arrangement supporting magnetic limbs, wherein the limbs are elongate; and (b) intermeshing the limbs at their lateral sides in a mutually abutting manner for providing the magnetic circuit when the system is in its assembled state.

According to a third aspect of the invention, there is provided a method of decoupling an underwater power connection system comprising at least two separable magnetic cores which are operable when coupled together to form a magnetic circuit, wherein the at least two cores are provided with respective one or more windings, characterized in that said method includes:

(a) arranging for the at least two separable magnetic cores to include a transverse magnetic member arrangement supporting magnetic limbs, wherein the limbs are elongate; and (b) separating the limbs from an intermeshed state with their lateral sides in a mutually abutting manner for breaking the magnetic circuit when the system is in its disassembled state.

DESCRIPTION OF THE DIAGRAMS

Figure 2A:
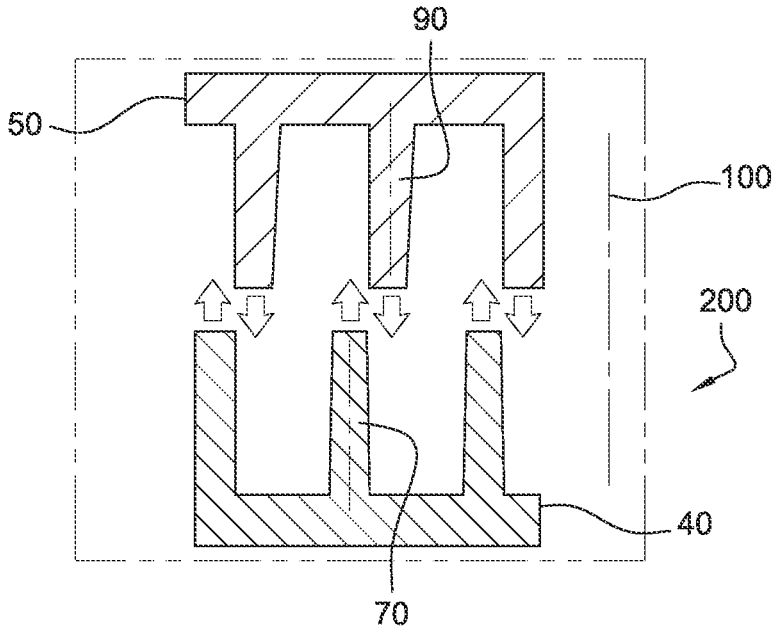
Figure 2B:
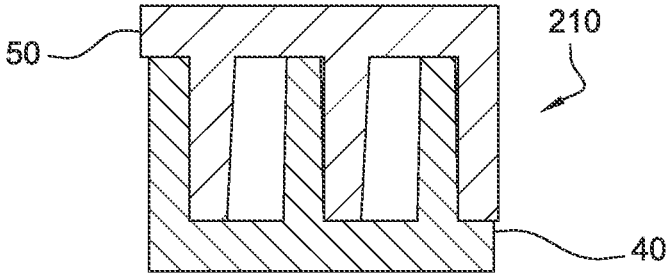
Figure 2C:
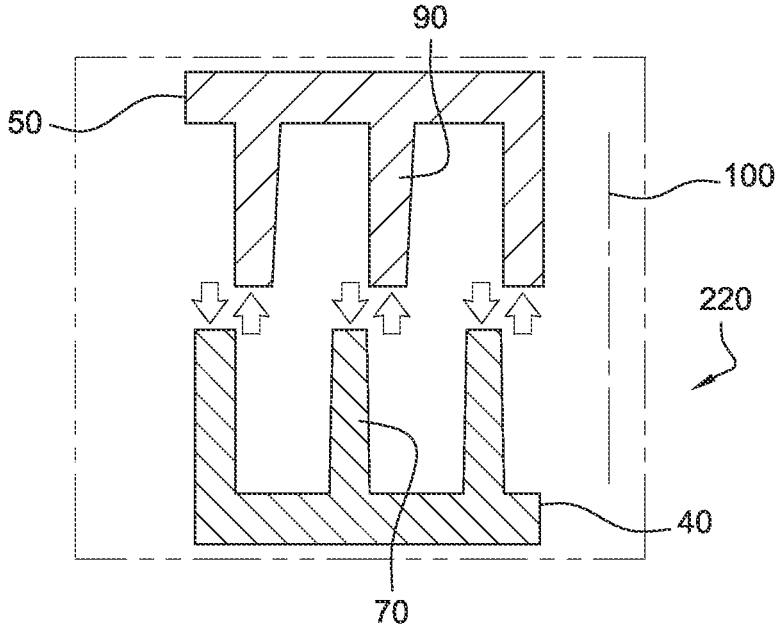
Figure 3:
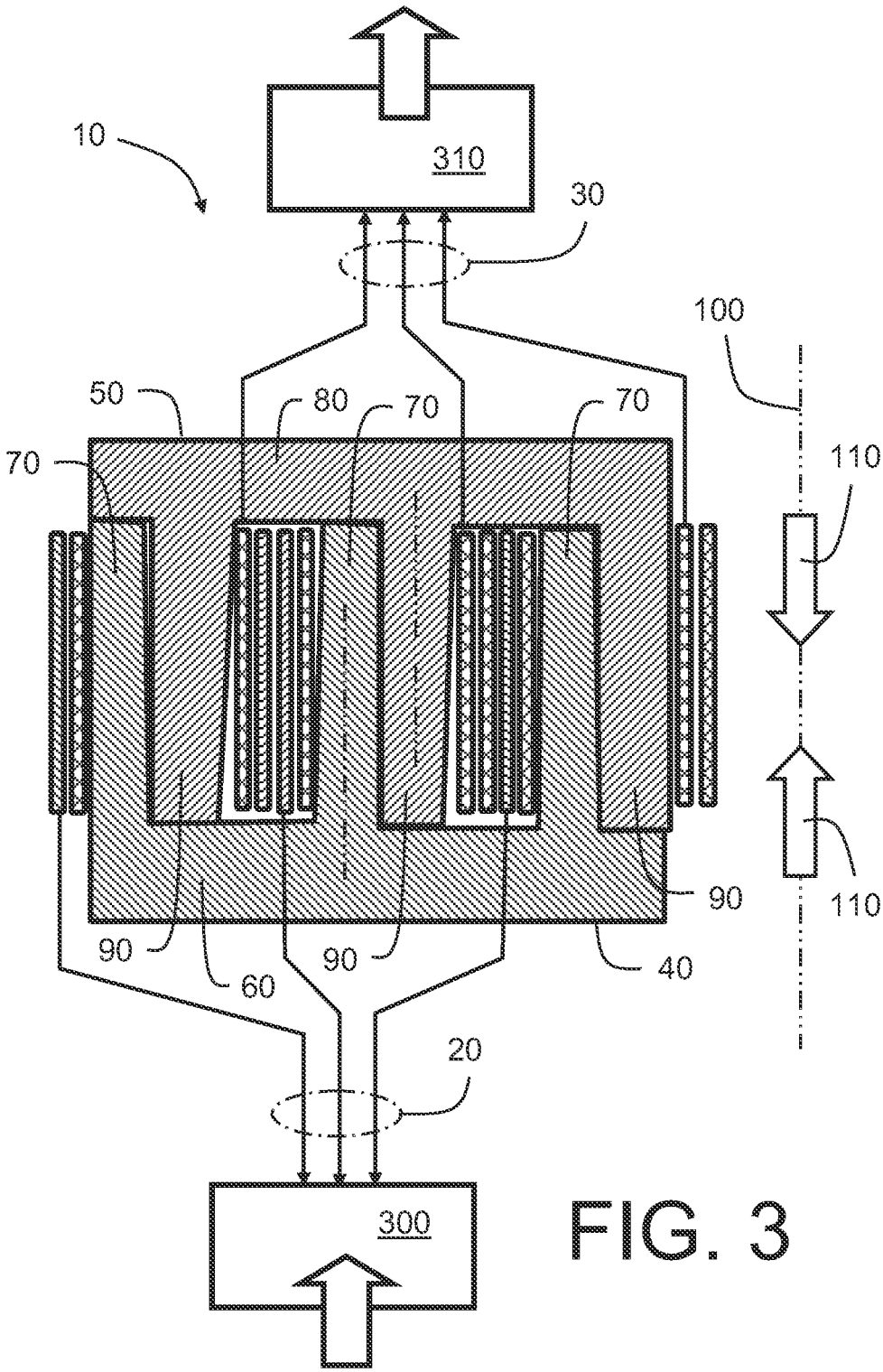

Embodiments of the present invention will now be described, by way of example only, with reference to the following diagrams wherein:

FIG. 1 is a cross-sectional view of an underwater power connector system pursuant to the present invention, FIG. 2A is a schematic view of the two magnetic cores of an underwater power connection system pursuant to the present invention, in a first step of their coupling, FIG. 2B is a schematic view of the cores of FIG. 2A, in a coupled configuration, FIG. 2C is a schematic view of the two magnetic cores of an underwater power connection system pursuant to the present invention, in a first step of their decoupling, FIG. 3 is a cross-sectional view of a modified implementation of the power connector system of FIG. 1.

In the accompanying diagrams, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DESCRIPTION OF EMBODIMENTS OF THE INVENTION

Referring to FIG. 1, there is shown an underwater power connector system pursuant to the present invention. The connector system is indicated generally by 10, and is operable to provide underwater power connections for electrical power supply at potentials of 6 kV and above. The connector system 10 is required, for example, for future installations where high-voltage (HV) cables are to be coupled to sub-sea equipment in oil and gas installations, offshore wind turbine parks ("farms") and sub-sea power grids. The connector system 10 potentially replaces contemporary 13.4 kV wet connectors wherein electrical contacts between mating electrodes are utilized, namely magnetic coupling is not employed. These contemporary wet connectors have difficulty achieving reliable insulation on account of electrical stresses that are encountered along their wetted surfaces. Although magnetic couplers are known as described in the foregoing, such known magnetic connectors are generally unsuitable for transferring large amounts of power in underwater applications. The connector system 10 illustrated in FIG. 1 is devoid of high-voltage (HV) insulation problems associated with contemporary connectors because a new manner of implementing a magnetic connection is employed in the system 10, wherein electrical components can be thoroughly enclosed and encapsulated, thereby completely avoiding exposure to saline sea water. Beneficially, the system 10 is used in conjunction with sea bottom placed production units that require in operation large amounts of power to function optimally, for example in excess of 20 MW.

In FIG. 1, the system 10 includes primary circuit cables 20 and secondary circuit cables 30 connected to corresponding primary and secondary windings respectively. Moreover, the system 10 employs magnetic coupling between the primary and secondary windings via a transformer implemented from a first magnetic core 40 associated with the primary windings, and a second magnetic core 50 associated with the secondary windings as illustrated. The first magnetic core 40 includes a transverse member 60 supporting three projecting limbs 70. Optionally, the limbs 70 are slightly tapered towards their distal ends remote from their transverse member 60. Likewise, the second magnetic core 50 includes a transverse member 80 supporting three projecting limbs 90. Optionally, the limbs 90 are slightly tapered towards their distal ends remote from their transverse member 80. Optionally, the transverse member 60 and its limbs 70 are an integral component fabricated from magnetic material of relative permeability considerably greater than unity. Moreover, the transverse member 60 and its limbs 70 are fabricated from at least one of: laminated magnetic material (for example from laminated silicon steel), from magnetic wires, from a ferrite composite material. Optionally, the transverse member 80 and its limbs 90 are an integral component fabricated from magnetic material of relative permeability considerably greater than unity. Moreover, the transverse member 80 and its limbs 90 are also fabricated from laminated magnetic material, for example fabricated from at least one of: laminated silicon steel, from magnetic wires, from a ferrite composite material. The limbs 70 of the first magnetic core 40 are dimensioned to intermesh as illustrated in FIG. 1 with the limbs 90 of the second magnetic core 60 when the system 10 is in its coupled state for transferring power by way of alternating magnetic coupling between the primary and secondary windings. Optionally, at least a portion of the limbs 70, 90 are implemented as at least part annuli; alternatively, the limbs 70, 90 are of a substantially rectilinear form as illustrated. The limbs 70, 90 are, as aforementioned, beneficially optionally slightly tapered, for example by an angle less than 5° in respect of an axis 100 as illustrated. The aforementioned primary and secondary windings are disposed to encircle on or more of the limbs 70, 90 so that the windings are magnetically coupled to a magnetic field which is established within the cores 40, 50 when the system 10 is in operation.

When the connector system 10 is to be decoupled, the first and second cores 40, 50 are pulled apart from one another with their corresponding primary and secondary windings attached respectively. The system 10 is of advantage in that the limbs 70, 90 are elongate in a direction denoted of the axis 100 in which the cores 40, 50 are coupled together as denoted by arrows 110. Such an arrangement as illustrated in FIG. 1 has several benefits as follows:

(a) there is a considerable mutually abutting surface area at sides of the limbs 70, 90 whereat they meet; this provides for better magnetic coupling in operation in comparison to known magnetic couplers described in the forgoing and renders the system 10 more tolerant to debris and growth which may occur onto sides of the limbs 70, 90. The optionally tapered nature of the limbs 70, 90 provides for yet further improved magnetic coupling and insensitivity to contamination collected on use onto the limbs 70, 90;

(b) the limbs 70, 90 abutting onto the transverse members 60, 80 define an extent to which the cores 40, 50 are brought together when the system 10 is in a coupled state; and (c) the limbs 70, 90 are beneficial in providing the system 10 with lateral rigidity transverse to the axis 100 and in-line with the axis 100 when the connector system 10 is in its coupled state.

Although not shown in FIG. 1 the system 10 includes insulating encapsulation of the cores 40, 50 and their windings to protect them from corrosion and ingress of saline sea water. Such insulating encapsulation is beneficially manufactured from epoxy, rubber, silicone, polyurethane or other robust insulating materials which are impervious to ingress of saline sea water. Optionally, the windings are enclosed in a thin-walled stainless steel (or similar non-magnetic metal) hollow housing filled with degasified insulating fluid so that pressures inside and outside the hollow housing are balanced in operation of the system 10.

Optionally, the system 10 is provided with a latching or locking mechanism for maintaining the cores 40, 50 tightly bound together when the system 10 is in its coupled state; optionally, the mechanism is implemented by way of a non-alternating electromagnet, namely direct current electromagnet. Optionally, the mechanism is implemented by way of a non-alternating current applied to additional attraction windings included spatial concurrently with the primary and/or secondary windings. The latching or locking mechanism is released when the system 10 is to be decoupled for mutually separating the cores 40, 50. Optionally, the latching or locking mechanism is implemented, at least in part, by actuated mechanical components which are arranged to mutually engage to provide a locking action when the system 10 is in its coupled state.

In FIG. 2, the system 10 in its decoupled state is indicated by 200, 220, and in its coupled state by 210. In the decoupled state 200 when progressing to couple the system 10 together, the cores 40, 50 are mutually brought together as indicated by broad arrows. In the coupled state 200 when progressing to decouple the system 10, the cores 40, 50 are mutually separated as indicated by broad arrows in the state 220.

In FIG. 3, the primary and secondary windings are provided with high-frequency switching units 300, 310 which include solid state switching devices and are operable to temporally chop signals supplied and/or generated at the primary and secondary windings for enabling the cores 40, 50 to operate at higher alternating frequencies. Such higher frequency operation, for example at substantially 400 Hz or even greater, enables the cores 40, 50 to be smaller and weigh less for a given power coupling capability of the system 10.

The system 10 is capable of coping with power transfer magnitudes in an order of Megawatts (MW), and also accommodating multi-phase power transfer by way of using multiple limbs 70, 9; for example, the system 10 is capable of supporting 3-phase power transfer therethrough. Such high power operation is starkly juxtaposed to contemporary magnetic couplers which typically are operable to couple in an order of Watts or a few kilowatts (kW). In the system 10, primary and secondary windings follow respective cores 40, 50 as aforementioned when the cores 40, 50 are mutually separated in operation.

Modifications to embodiments of the invention described in the foregoing are possible without departing from the scope of the invention as defined by the accompanying claims. Expressions such as "including", "comprising", "incorporating", "consisting of", "have", "is" used to describe and claim the present invention are intended to be construed in a non-exclusive manner, namely allowing for items, components or elements not explicitly described also to be present. Reference to the singular is also to be construed to relate to the plural. Numerals included within parentheses in the accompanying claims are intended to assist understanding of the claims and should not be construed in any way to limit subject matter claimed by these claims.

The invention claimed is:

1. An underwater power connection system comprising:

at least two separable magnetic cores which are operable when coupled together to form a magnetic circuit, wherein said at least two cores are provided with respective one or more windings, and said cores include a transverse magnetic member arrangement supporting magnetic limbs, wherein said magnetic limbs are elongate and are adapted to intermesh with their lateral sides mutually abutting for providing the magnetic circuit when the system is in its assembled state, wherein the limbs are of tapered form towards their distal ends.

2. An underwater power connection system as claimed in claim 1, wherein the limbs are elongate in a direction corresponding to a direction in which the cores are mutually coupled together and/or decoupled from one another.

3. An underwater power connection system as claimed in claim 1, wherein the cores are fabricated from at least one of: laminate magnetically permeable sheet, magnetically permeable wire, ferrite materials.

4. An underwater power connection system as claimed in claim 1 wherein the cores have associated therewith multiple windings for enabling the system to couple multi-phase alternating electrical power therethrough.

5. An underwater power connection system as claimed in claim 1, wherein the windings are included within hollow non-magnetic metal enclosures including insulating fluid which is arranged to be maintained at a substantially similar pressure to an underwater operating environment of the system.

6. An underwater power connection system as claimed in claim 1, further including frequency conversion units coupled to the windings for enabling power to be transferred via the cores at an increased alternating frequency.

7. An underwater power connection system as claimed in claim 1, further including a latching mechanism for maintaining the at least two cores coupled together when in a mutually coupled state.

8. A method of coupling an underwater power connection system having at least two separable magnetic cores which are operable when coupled together to form a magnetic circuit, wherein said at least two cores are provided with respective one or more windings, said method comprising the steps of:

(a) arranging for said at least two separable magnetic cores to include a transverse magnetic member arrangement supporting magnetic limbs, wherein the limbs are elongate; and (b) intermeshing the limbs at their lateral sides in a mutually abutting manner for providing the magnetic circuit when the system is in its assembled state.

9. A method of decoupling an underwater power connection system having at least two separable magnetic cores which are operable when coupled together to form a magnetic circuit, wherein said at least two cores are provided with respective one or more windings, said method comprising the steps of:

(a) arranging for said at least two separable magnetic cores to include a transverse magnetic member arrangement supporting magnetic limbs, wherein the limbs are elongate; and (b) separating the limbs in an intermeshed state with their lateral sides in a mutually abutting manner for breaking the magnetic circuit when the system is in its disassembled state.

* * * * *